US011415921B2

(12) United States Patent
Mochizuki

(10) Patent No.: US 11,415,921 B2
(45) Date of Patent: Aug. 16, 2022

(54) IMAGE FORMING APPARATUS FOR REGULATING REMOVAL OF DEVELOPER STORING PORTION, AND REGULATION RELEASING METHOD

(71) Applicant: KYOCERA Document Solutions Inc., Osaka (JP)

(72) Inventor: Masayuki Mochizuki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/461,645

(22) Filed: Aug. 30, 2021

(65) Prior Publication Data

US 2022/0066373 A1 Mar. 3, 2022

(30) Foreign Application Priority Data

Aug. 31, 2020 (JP) ..... JP2020-145974

(51) Int. Cl.
*G03G 15/00* (2006.01)

(52) U.S. Cl.
CPC ..... *G03G 15/55* (2013.01)

(58) Field of Classification Search
CPC .. G03G 15/5012; G03G 15/55; G03G 15/553; G03G 15/556; G03G 15/70; G03G 15/703; G03G 15/706; G03G 21/1633; G03G 21/1638
See application file for complete search history.

(56) References Cited

U.S. PATENT DOCUMENTS 6,371,471 B1 * 4/2002 Fukazu ..... G03G 15/6582 270/58.08
2010/0272452 A1 * 10/2010 Tsukijima ..... G03G 21/1633 399/81
2017/0315470 A1 * 11/2017 Mochizuki ..... G03G 21/1638
2017/0315501 A1 * 11/2017 Mochizuki ..... G03G 15/556
2017/0315502 A1 * 11/2017 Mochizuki ..... G03G 15/55
2019/0302686 A1 * 10/2019 Mochizuki ..... G03G 21/1839

FOREIGN PATENT DOCUMENTS

JP 2001072318 A 3/2001

* cited by examiner

*Primary Examiner* — Carla J Therrien
(74) *Attorney, Agent, or Firm* — Alleman Hall Creasman & Tuttle LLP

(57) ABSTRACT

An image forming apparatus includes a control portion, a switching processing portion, a determination processing portion, and a release processing portion. The control portion includes a detection portion that detects abnormality regarding an image forming portion, and controls the image forming portion. When the abnormality detected by the detection portion is a first abnormality, the switching processing portion switches an operation mode of the image forming apparatus from a normal mode to a stop mode in which the control portion is stopped. When a specific operation is performed in a case where the operation mode is the stop mode, the determination processing portion determines whether or not a second abnormality is continued, based on a record result of detection of the abnormality. When it is determined that the second abnormality is continued, the release processing portion releases regulation on a removal of a developer storing portion.

4 Claims, 9 Drawing Sheets

IMAGE FORMING APPARATUS FOR REGULATING REMOVAL OF DEVELOPER STORING PORTION, AND REGULATION RELEASING METHOD

INCORPORATION BY REFERENCE

This application is based upon and claims the benefit of priority from the corresponding Japanese Patent Application No. 2020-145974 filed on Aug. 31, 2020, the entire contents of which are incorporated herein by reference.

BACKGROUND

The present disclosure relates to an image forming apparatus and a regulation releasing method to be executed in the image forming apparatus.

Conventionally known is an image forming apparatus including a regulation portion capable of regulating removal of a developer storing portion, such as a toner container storing developer such as toner, from an attachment portion to which the developer storing portion has been attached. For example, this type of image forming apparatus includes a second control portion provided separately from a first control portion that integrally controls the image forming apparatus, and a restriction processing portion. The second control portion has a detection portion that detects abnormality regarding an image forming portion that forms an image by using the developer. The second control portion controls the image forming portion. The restriction processing portion restricts the operation of the image forming apparatus when the abnormality is detected by the detection portion.

For example, in the image forming apparatus, when a predetermined specific operation such as an operation to open a cover member is performed, it is determined whether or not a predetermined second abnormality in the abnormality is continued, based on a result of communication with the second control portion. When it is determined that the second abnormality is continued, the regulation on the removal of the developer storing portion imposed by the regulation portion is released. With this configuration, in the occurrence of the abnormality (the second abnormality) requiring the removal of the developer storing portion in order to investigate and eliminate a cause of the abnormality, the developer storing portion can be removed.

In addition, in the image forming apparatus, when a predetermined first abnormality in the abnormality is detected, an operation mode of the image forming apparatus may be switched from a normal mode to a stop mode in which the second control portion is stopped, and the restriction on the operation of the image forming apparatus may be released.

SUMMARY

An image forming apparatus according to one aspect of the present disclosure includes an image forming portion, an attachment portion, a regulation portion, a control portion, a restriction processing portion, a switching processing portion, a determination processing portion, and a release processing portion. The image forming portion forms an image by using developer. A developer storing portion that stores the developer is attached to the attachment portion. The regulation portion regulates a removal of the developer storing portion attached to the attachment portion from the attachment portion. The control portion includes a detection portion that detects abnormality regarding the image forming portion. The control portion controls the image forming portion. When the abnormality is detected by the detection portion, the restriction processing portion restricts operation of the image forming apparatus. When the abnormality detected by the detection portion is a predetermined first abnormality, the switching processing portion switches an operation mode of the image forming apparatus from a normal mode to a stop mode in which the control portion is stopped, and releases restriction on the operation of the image forming apparatus imposed by the restriction processing portion. When a predetermined specific operation is performed in a case where the operation mode is the stop mode, the determination processing portion determines whether or not a predetermined second abnormality in the abnormality is continued, based on a record result of the abnormality detection. When the determination processing portion determines that the second abnormality is continued, the release processing portion releases regulation on the removal of the developer storing portion imposed by the regulation portion.

A regulation releasing method according to another aspect of the present disclosure is executed in an image forming apparatus including an image forming portion that forms an image by using developer, an attachment portion to which a developer storing portion that stores the developer is attached, a regulation portion that regulates a removal of the developer storing portion attached to the attachment portion from the attachment portion, and a control portion having a detection portion that detects abnormality regarding the image forming portion, the control portion controlling the image forming portion. The regulation releasing method includes a restriction step, a switching step, a determination step, and a releasing step. In the restriction step, when the abnormality is detected by the detection portion, operation of the image forming apparatus is restricted. In the switching step, in a case where the abnormality detected by the detection portion is a predetermined first abnormality, an operation mode of the image forming apparatus is switched from a normal mode to a stop mode in which the control portion is stopped, and restriction on the operation of the image forming apparatus imposed by the restriction step is released. In the determination step, when a predetermined specific operation is performed in a case where the operation mode is the stop mode, it is determined whether or not a predetermined second abnormality in the abnormality is continued, based on a record result of the abnormality detection. In the releasing step, when the determination step determines that the second abnormality is continued, regulation on the removal of the developer storing portion imposed by the regulation portion is released.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 100]

Firstly, a configuration of an image forming apparatus 100 according to an embodiment of the present disclosure will be described with reference to FIG. 1 and FIG. 2. Here, FIG. 2 is a perspective view showing an appearance of the image forming apparatus 100. FIG. 2 shows the image forming apparatus 100 in a state where an ADF 1 is removed.

For convenience of the explanation, the vertical direction in an installation state where the image forming apparatus 100 is installed in a usable manner (the state shown in FIG. 2) is defined as an up-down direction D1. In addition, a front-rear direction D2 is defined on the supposition that a front right side surface of the image forming apparatus 100 shown in FIG. 2 is a front (front surface). In addition, a left-right direction D3 is defined with reference to the front of the image forming apparatus 100 in the installation state.

The image forming apparatus 100 is a multifunction peripheral having multiple functions such as a scan function that reads an image of a document sheet, a print function that forms an image based on an image data, a facsimile function and a copy function, etc. The image forming apparatus 100 may be a printer device, a facsimile apparatus, or a copier.

Figure 1:
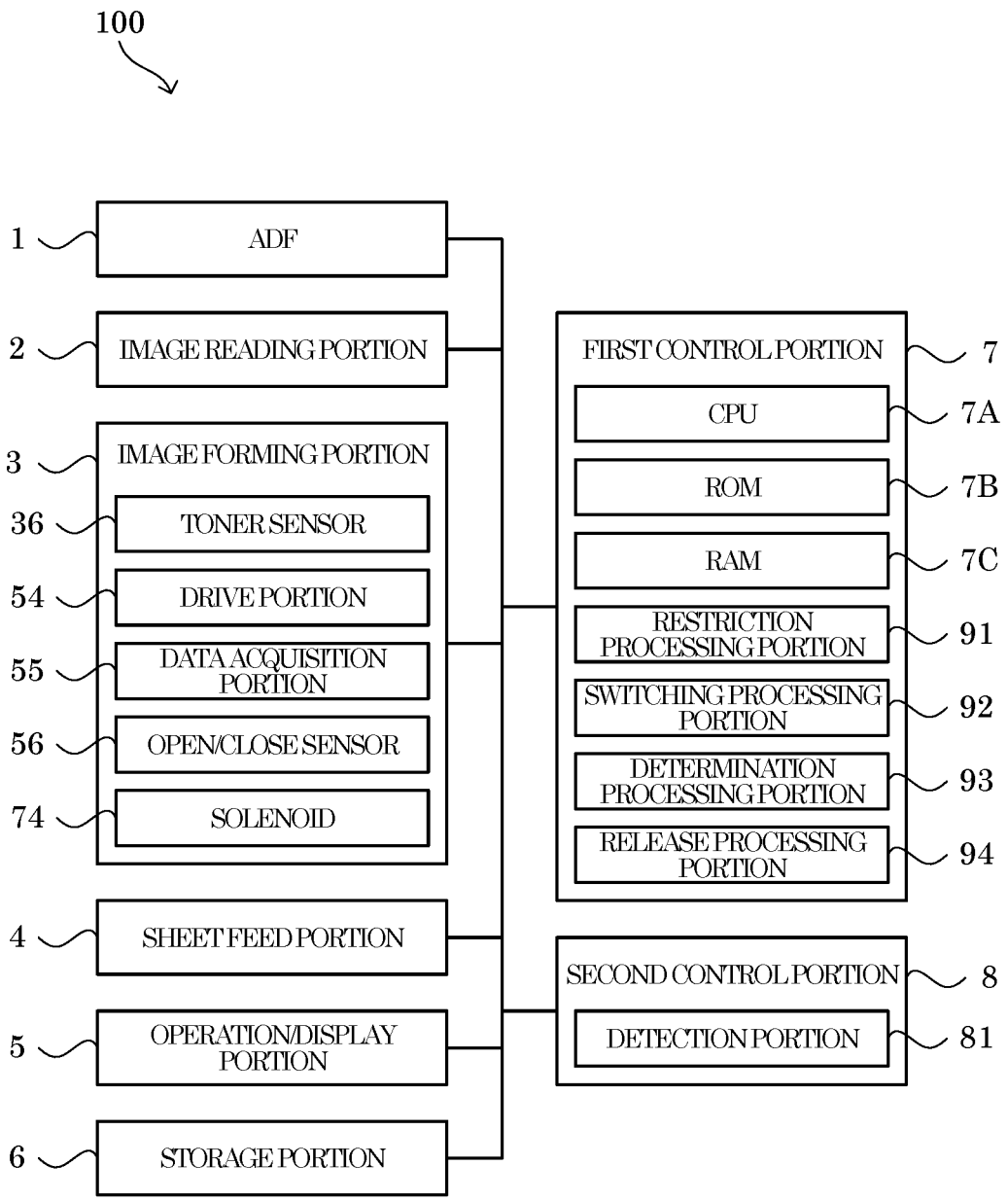
FIG. 1 is a block diagram showing a system configuration of an image forming apparatus according to an embodiment of the present disclosure.
Figure 2:
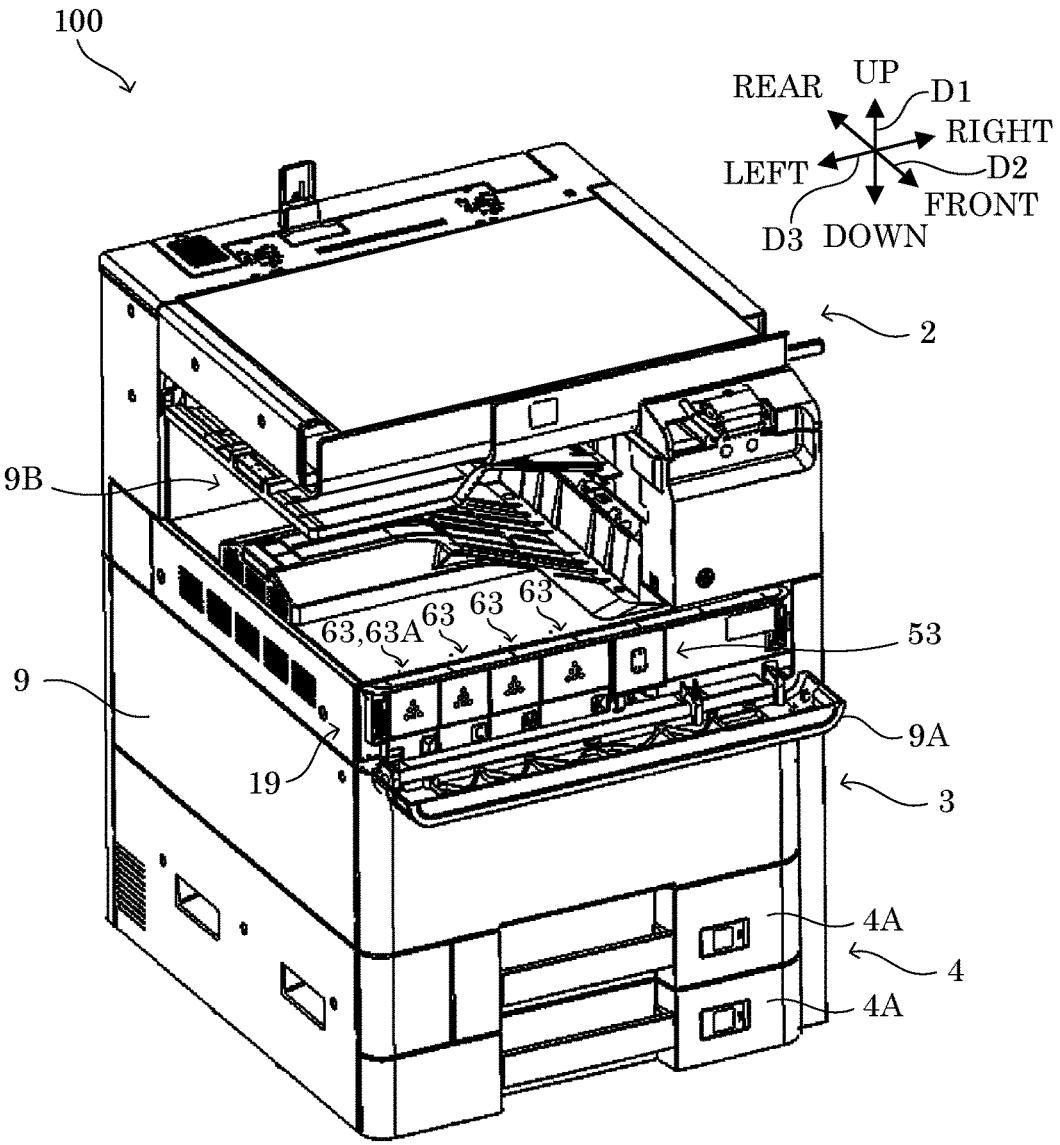
FIG. 2 is a diagram showing an appearance of the image forming apparatus according to the embodiment of the present disclosure.

As shown in FIG. 1 and FIG. 2, the image forming apparatus 100 includes the ADF (Auto Document Feeder) 1, an image reading portion 2, an image forming portion 3, a sheet feed portion 4, an operation/display portion 5, a storage portion 6, a first control portion 7, a second control portion 8, and a housing 9.

The ADF 1 conveys the document sheet targeted to be read by the scan function. For example, the ADF 1 includes a document setting portion, a plurality of conveying rollers, a document sheet holder, and a sheet ejecting portion.

The image reading portion 2 realizes the scan function. For example, the image reading portion 2 includes a document sheet table, a light source, a plurality of mirrors, an optical lens, and a CCD (Charge Coupled Device).

The image forming portion 3 realizes the print function. Specifically, the image forming portion 3 forms the image by electrophotography. For example, the image forming portion 3 forms the image by using developer including toner (an example of the developer of the present disclosure) and career.

The sheet feed portion 4 feeds a sheet to the image forming portion 3. For example, the sheet feed portion 4 includes sheet feed cassettes 4A (see FIG. 2), a sheet conveyance path, and a plurality of conveying rollers.

The operation/display portion 5 is a user interface of the image forming apparatus 100. For example, the operation/display portion 5 includes a display portion such as a liquid crystal display that displays various types of information in accordance with control commands from the first control portion 7, and an operation portion such as an operation key or a touch panel, which inputs various types of information to the first control portion 7 in accordance with operations of a user.

The storage portion 6 is a non-volatile storage device. For example, the storage portion 6 is a storage device such as: a non-volatile memory such as a flash memory or an EEPROM; an SSD (Solid State Drive); or an HDD (Hard Disk Drive).

The first control portion 7 centrally controls the image forming apparatus 100. As shown in FIG. 1, the first control portion 7 includes a CPU 7A, a ROM 7B, and a RAM 7C. The CPU 7A is a processor that executes various types of calculation process. The ROM 7B is the non-volatile storage device in which information such as control program for causing the CPU 7A to execute various types of process is prestored. The RAM 7C is a volatile storage device used as a temporary storage memory (working area) for the various types of process executed by the CPU 7A. In the first control portion 7, the CPU 7A executes the various types of control program that is prestored in the ROM 7B. Thus, the image forming apparatus 100 is centrally controlled by the first control portion 7.

The second control portion 8 controls the image forming portion 3. For example, the second control portion 8 is composed of electronic circuits such as integrated circuits (ASIC, DSP). The second control portion 8 is an example of the control portion of the present disclosure.

The housing 9 houses some components of the image forming apparatus 100. As shown in FIG. 2, the housing 9 is formed in a substantially square columnar shape. The sheet feed cassettes 4A are provided at a lower portion of the housing 9 so as to be inserted and extracted in the front-rear direction D2. A front cover 9A is provided on the front surface of the housing 9. A lower end part of the front cover 9A is supported in such a way as to be pivotable around a rotary shaft that is elongated in the left-right direction D3, and the front cover 9A is opened as its upper part pivots forward. On the housing 9, there is provided a sheet ejecting space 9B that is opened to the left and the front. A sheet with an image formed thereon by the image forming portion 3 is ejected into the sheet ejecting space 9B.

[Configuration of Image Forming Portion 3]

Figure 3:
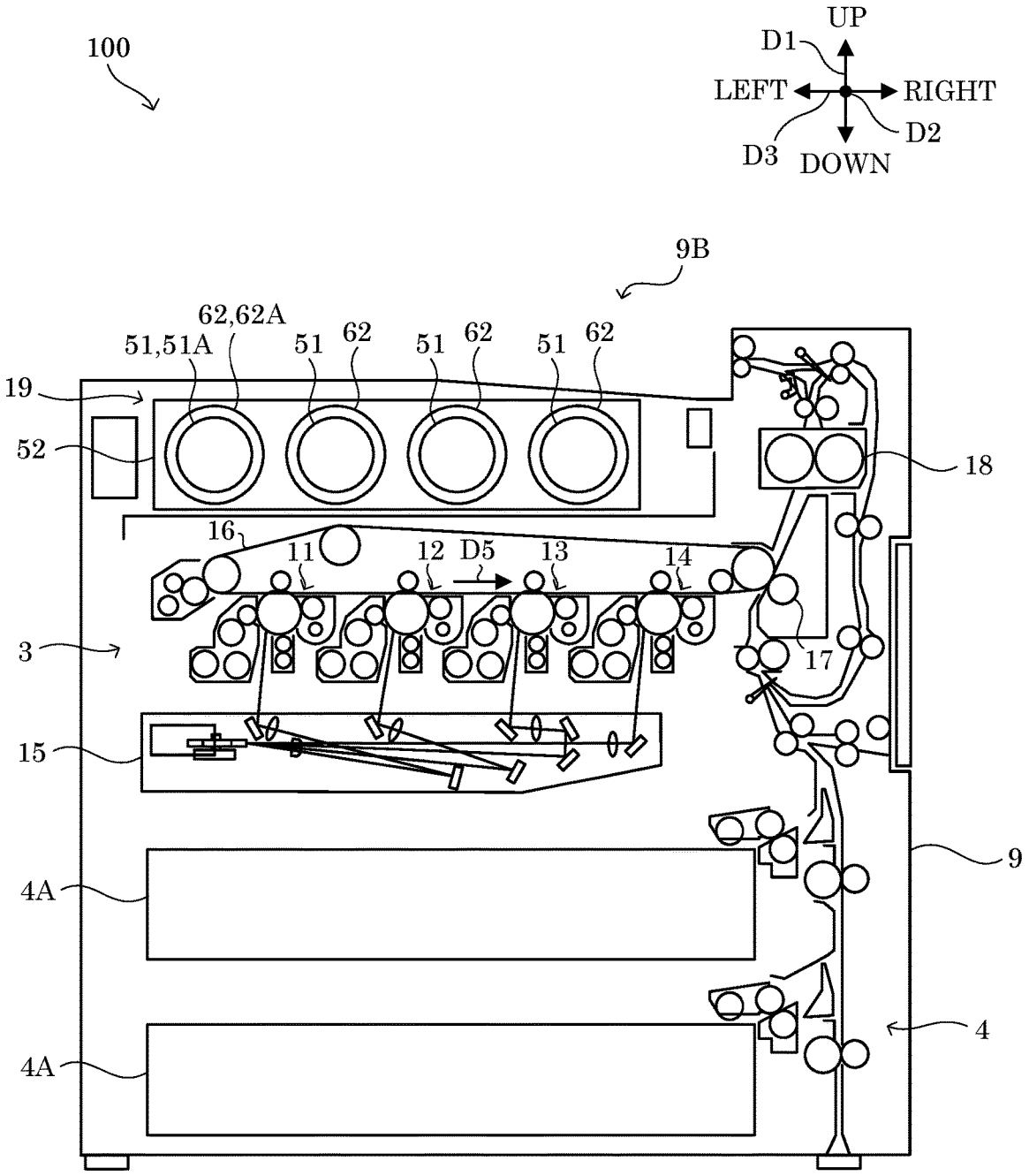
FIG. 3 is a diagram showing an internal configuration of the image forming apparatus according to the embodiment of the present disclosure.

Next, a configuration of the image forming portion 3 will be described with reference to FIG. 3 and FIG. 4. Here, FIG. 3 is a cross-sectional view showing an internal configuration of the housing 9. In addition, FIG. 4 is a cross-sectional view showing a configuration of an image forming unit 11.

As shown in FIG. 3, the image forming portion 3 includes a plurality of image forming units 11 to 14, a laser scanning unit 15, an intermediate transfer belt 16, a secondary transfer roller 17, a fixing device 18, and a toner supply device 19.

The image forming units 11 to 14 are electrophotographic image forming units, the image forming unit 11 corresponding to Y (yellow), the image forming unit 12 corresponding to C (cyan), the image forming unit 13 corresponding to M (magenta), and the image forming unit 14 corresponding to K (black). As shown in FIG. 3, the image forming units 11 to 14 are aligned along the left-right direction D3 of the image forming apparatus 100, in the order of yellow, cyan, magenta, and black from the left side of the image forming apparatus 100.

Figure 4:
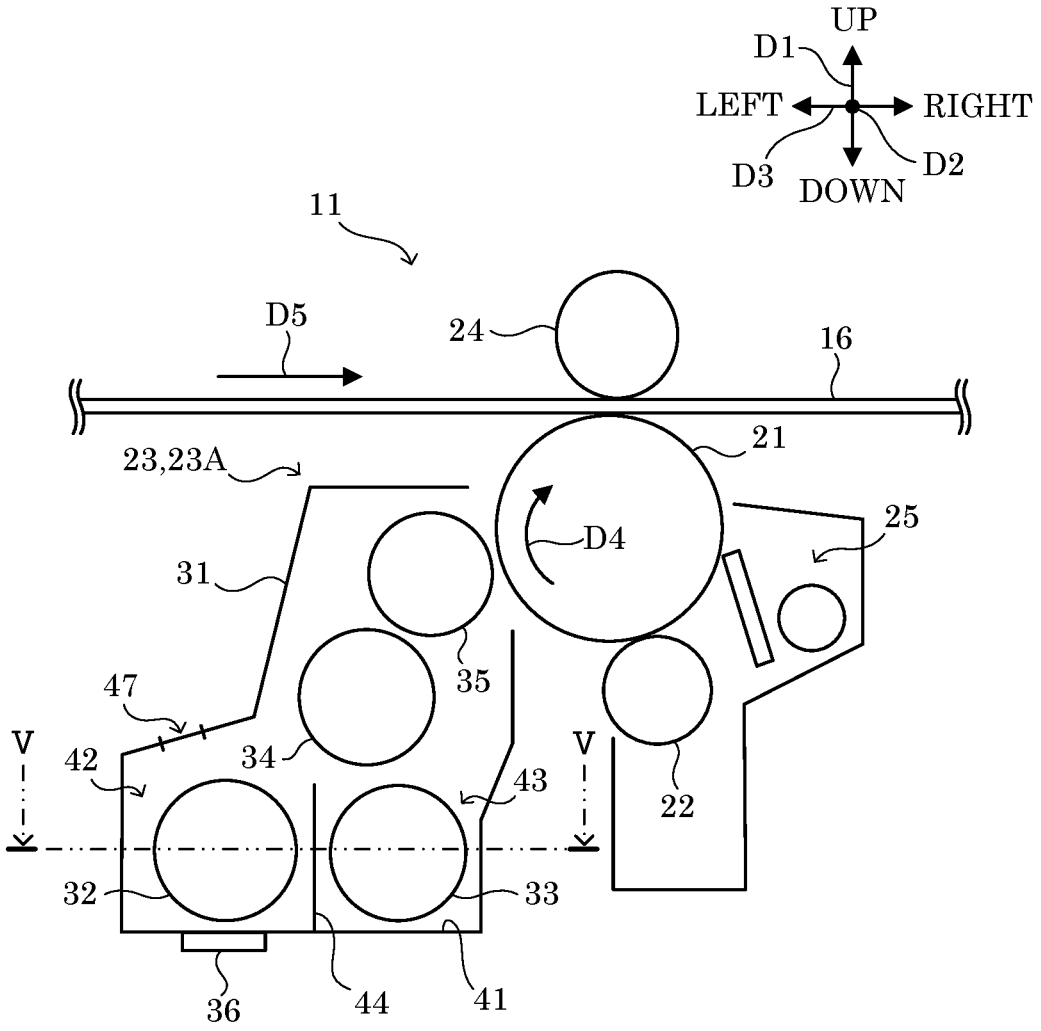
FIG. 4 is a diagram showing a configuration of an image forming unit in the image forming apparatus according to the embodiment of the present disclosure.

As shown in FIG. 4, the image forming unit 11 includes a photoconductor drum 21, a charging roller 22, a development portion 23, a primary transfer roller 24, and a drum cleaning portion 25. In addition, the image forming units 12 to 14 have the same configuration as the image forming unit 11.

An electrostatic latent image is formed on a surface of the photoconductor drum 21. The photoconductor drum 21 receives a rotational driving force that is supplied from a motor (not shown) and rotates in a rotational direction D4 shown in FIG. 4.

The charging roller 22 charges the surface of the photoconductor drum 21. A light emitted from the laser scanning unit 15 based on the image data is irradiated to the surface of the photoconductor drum 21 that has been charged by the charging roller 22. This allows the electrostatic latent image to be formed on the surface of the photoconductor drum 21.

The development portion 23 develops the electrostatic latent image formed on the surface of the photoconductor drum 21 by using the developer. This allows a toner image to be formed on the surface of the photoconductor drum 21.

The primary transfer roller 24 transfers the toner image that has been formed on the surface of the photoconductor drum 21 by the development portion 23, to the intermediate transfer belt 16.

The drum cleaning portion 25 removes the toner remaining on the surface of the photoreceptor drum 21 after the transfer of the toner image by the primary transfer roller 24.

The laser scanning unit 15 emits light based on the image data, toward the surfaces of the photoconductor drums 21 of the image forming units 11 to 14.

The intermediate transfer belt 16 is an endless belt member to which the toner images formed on the surfaces of the photoconductor drums 21 of the image forming units 11 to 14 are transferred. The intermediate transfer belt 16 is stretched by a drive roller and a stretch roller with a predetermined tension. The drive roller is rotated in response to a rotational driving force that is supplied from a motor (not shown), and thereby the intermediate transfer belt 16 is rotated in a rotational direction D5 shown in FIG. 3.

The secondary transfer roller 17 transfers the toner image that has been transferred on the surface of the intermediate transfer belt 16, to the sheet that is fed from the sheet feed portion 4.

The fixing device 18 fixes the toner image that has been transferred to the sheet by the secondary transfer roller 17, to the sheet.

The toner supply device 19 supplies the toner to the development portions 23 of the image forming units 11 to 14.

[Configuration of Development Portion 23]

Next, a configuration of the development portion 23 will be described with reference to FIG. 4 and FIG. 5. Here, FIG. 5 is a cross-sectional view taken along a V-V line and viewed from the direction of arrows of FIG. 4.

Figure 5:
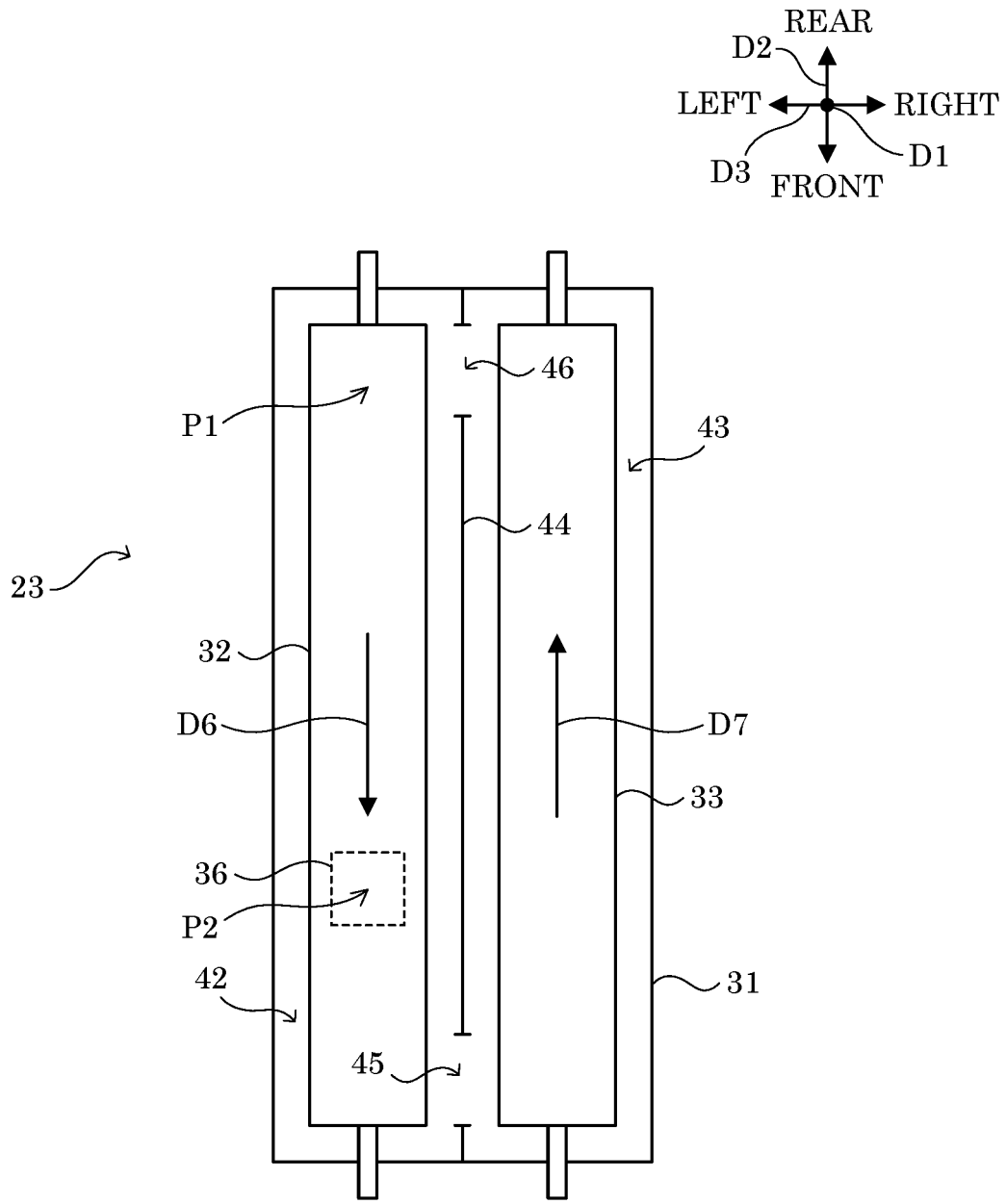
FIG. 5 is a diagram showing a configuration of a development portion in the image forming apparatus according to the embodiment of the present disclosure.

As shown in FIG. 4 and FIG. 5, the development portion 23 includes a housing 31, a first conveyance member 32, a second conveyance member 33, a magnet roller 34, a developing roller 35, and a toner sensor 36.

As shown in FIG. 4, the housing 31 houses the first conveyance member 32, the second conveyance member 33, the magnet roller 34, and the developing roller 35. In addition, the housing 31 stores the developer. Specifically, the housing 31 stores the developer in an internal space defined by side walls and a bottom 41. The development portion 23 develops the electrostatic latent image that has been formed on the surface of the photoconductor drum 21 by using the developer stored in the housing 31.

As shown in FIG. 5, the housing 31 has a first conveyance path 42 and a second conveyance path 43 in which the developer including the toner is conveyed. Specifically, as shown in FIG. 4 and FIG. 5, a partition wall 44 is provided on the bottom 41 of the housing 31. The side walls, the bottom 41, and the partition wall 44 of the housing 31 form the first conveyance path 42 and the second conveyance path 43 in which the developer is conveyed in the housing 31.

As shown in FIG. 5, the first conveyance member 32 is provided in the first conveyance path 42. The first conveyance member 32 conveys the developer along a conveyance direction D6 along the front-rear direction D2 in the first conveyance path 42, and charges the toner included in the developer. Specifically, the first conveyance member 32 stirs the developer during the conveyance of the developer, and charges the toner included in the developer. For example, the first conveyance member 32 is a screw-shaped member.

As shown in FIG. 5, the second conveyance member 33 is provided in the second conveyance path 43. The second conveyance member 33 conveys the developer along a conveyance direction D7 along the front-rear direction D2 in the second conveyance path 43, and charges the toner included in the developer. Specifically, the second conveyance member 33 stirs the developer during the conveyance of the developer, and charges the toner included in the developer. For example, the second conveyance member 33 is a screw-shaped member.

A first connection portion 45 that connects the first conveyance path 42 and the second conveyance path 43 is provided at a downstream end, in the conveyance direction D6, of the partition wall 44. On the other hand, a second connection portion 46 that connects the first conveyance path 42 and the second conveyance path 43 is provided at a downstream end, in the conveyance direction D7, of the partition wall 44. Thus, the developer that is stored in the housing 31 is circulated and conveyed through the first conveyance path 42 and the second conveyance path 43 by the first conveyance member 32 and the second conveyance member 33.

The magnet roller 34 draws up the developer that is conveyed by the second conveyance member 33, from the second conveyance path 43. The magnet roller 34 supplies the toner included in the developer drawn up from the second conveyance path 43, to the developing roller 35. The developing roller 35 develops the electrostatic latent image that is formed on the surface of the photoconductor drum 21 by using the toner supplied from the magnet roller 34.

It is noted that the development method adopted by the development portion 23 is not limited to the two-component development method using the developer that includes the toner and the career. The development method of the development portion 23 may be, e.g., one-component development method using only the toner. In addition, the development portion 23 may be configured without the magnet roller 34.

An opening portion 47 is provided above the first conveyance path 42. As shown in FIG. 4, the opening portion 47 is provided in an upper surface of the housing 31 that covers the first conveyance path 42 from above. The opening portion 47 is provided facing an upstream end, in the conveyance direction D6, of the first conveyance path 42. The opening portion 47 is used to convey the toner that is supplied from a toner container 51, which is described later, into the first conveyance path 42. Specifically, the toner that is supplied from the toner container 51 passes through the opening portion 47 and is conveyed to a conveyance position P1 (see FIG. 5) of the first conveyance path 42. The conveyance position P1 is a position provided on the bottom 41 to face the opening portion 47.

The toner sensor 36 detects an amount of toner at a detection position P2 (see FIG. 5) positioned on a more downstream side in the conveyance direction D6 than the conveyance position P1 in the first conveyance path 42. The toner sensor 36 is, for example, provided on a bottom of the housing 31, as shown in FIG. 4. The toner sensor 36 is, for example, a permeability sensor including an LC oscillation circuit that outputs an electric signal corresponding to a permeability of the developer stored inside the housing 31.

For example, in the image forming apparatus 100, the amount of toner stored inside the housing 31 is obtained by integrating the values detected by the toner sensor 36 during a detection period that is longer than the time required for the first conveyance member 32 to convey the toner from the conveyance position P1 to the detection position P2. For example, the detection period equals to a time period required for the toner that is conveyed by the first conveyance member 32 to circulate inside the development portion 23 once.

[Configuration of Toner Supply Device 19]

Figure 6:
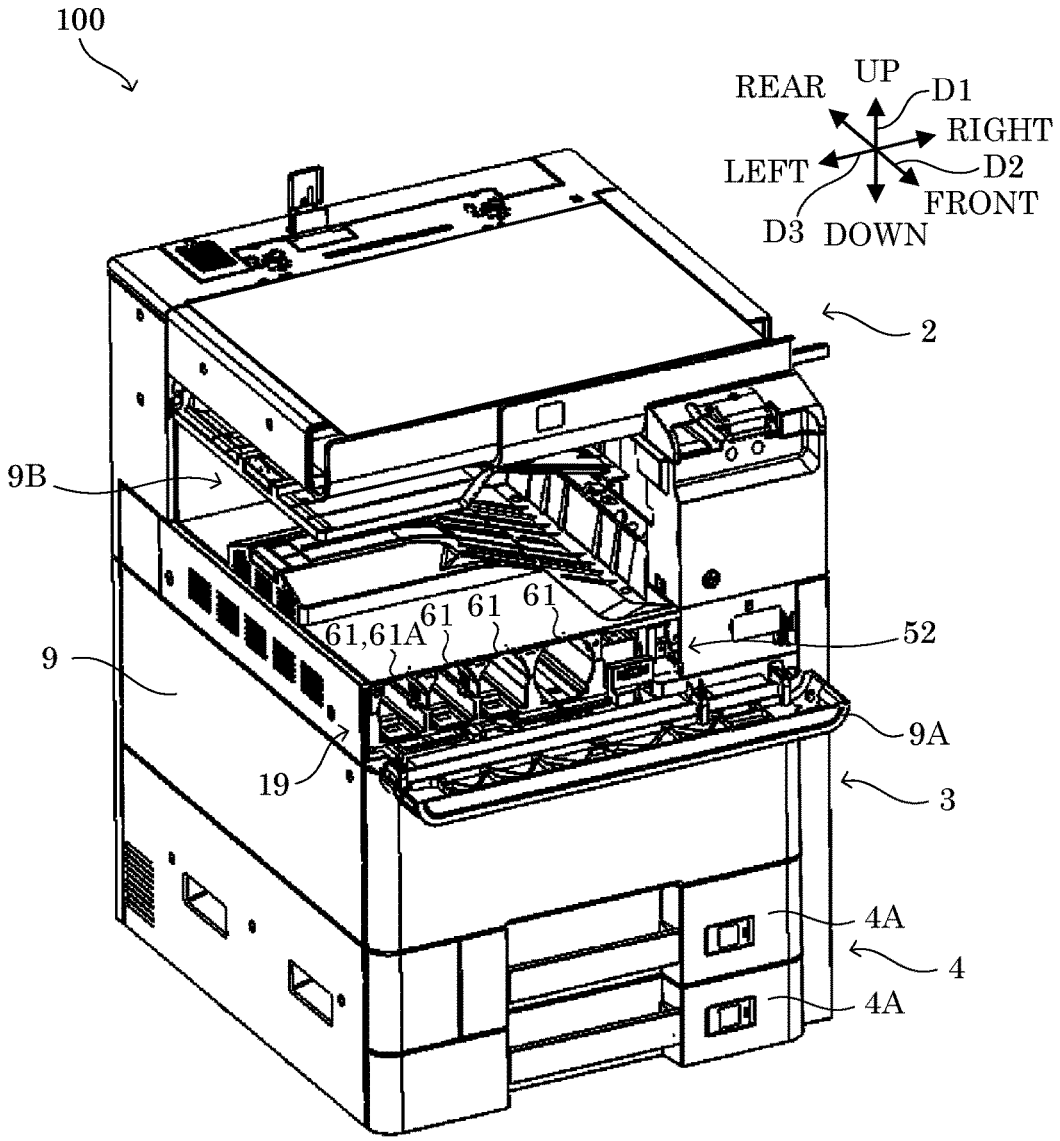
FIG. 6 is a diagram showing an appearance of the image forming apparatus according to the embodiment of the present disclosure.
Figure 7:
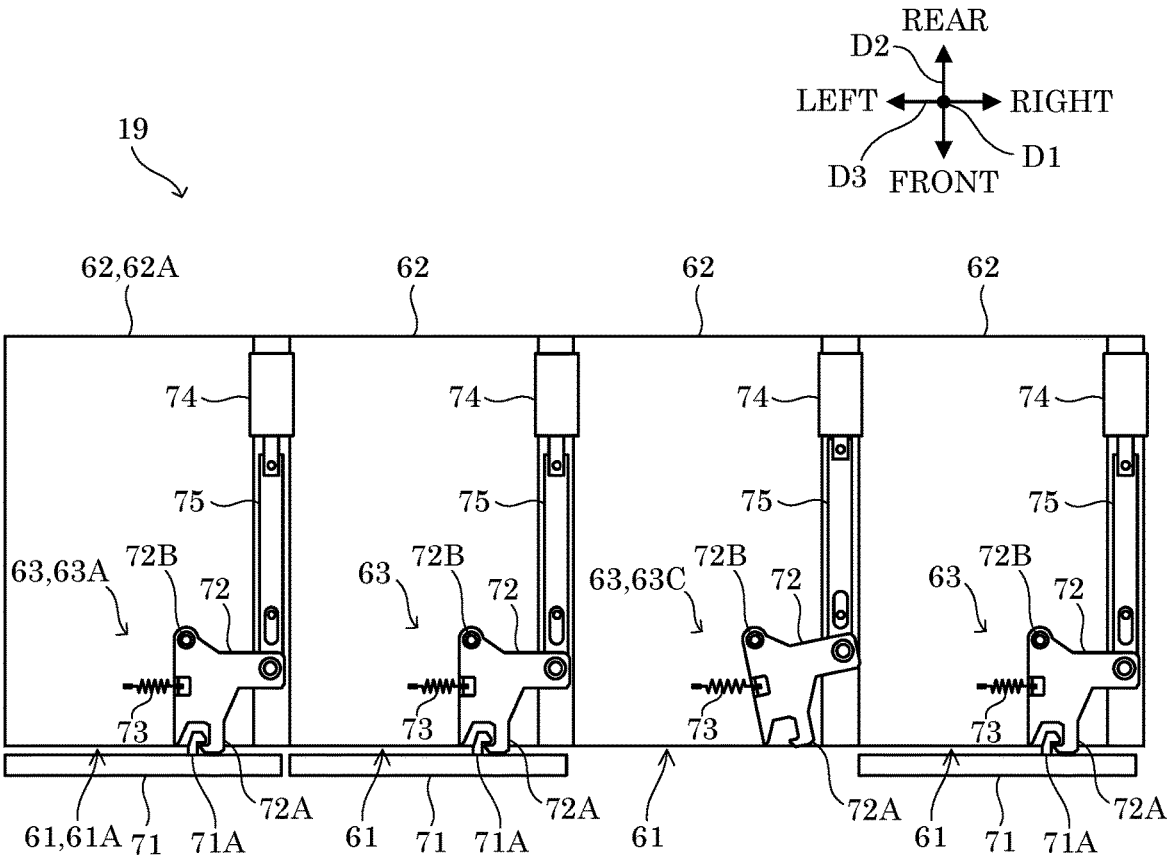
FIG. 7 is a diagram showing a configuration of a toner supply device in the image forming apparatus according to the embodiment of the present disclosure.

Next, a configuration of the toner supply device 19 will be described with reference to FIG. 1 to FIG. 3, FIG. 6 and FIG. 7. Here, FIG. 6 is a drawing showing a state in which a lock unit 53 is removed from the image forming apparatus 100 shown in FIG. 2. In addition, FIG. 7 is a plan view showing a configuration of the toner supply device 19.

The toner supply device 19 includes four toner containers 51 shown in FIG. 3, a container attachment portion 52 shown in FIG. 6, and the lock unit 53 shown in FIG. 2. In addition, as shown in FIG. 1, the toner supply device 19 includes a drive portion 54, a data acquisition portion 55, and an open/close sensor 56.

The four toner containers 51 are provided in correspondence with the image forming units 11 to 14. For example, a toner container 51A shown in FIG. 3 corresponds to the image forming unit 11 and stores yellow toner.

The four toner containers 51 have the same configuration as each other. Specifically, each toner container 51 is a substantially cylindrical container that is elongated along the front-rear direction D2. Each toner container 51 includes a conveyance member (not shown) that conveys the toner stored therein along a longitudinal direction of each toner container 51, and an IC tag (not shown) that stores specific data regarding each toner container 51. For example, the specific data includes identification information of each toner container 51, toner information regarding the type, material, and color of the toner stored in each toner container 51, and initial storage capacity information showing an initial storage capacity of the toner in each toner container 51. The toner container 51 is an example of a developer storing portion of the present disclosure.

The four toner containers 51 are attached to the container attachment portion 52. As shown in FIG. 3, the container attachment portion 52 is provided at an upper part of the housing 9. In addition, as shown in FIG. 6, the container attachment portion 52 is provided in the housing 9 at a position facing a rear of the front cover 9A. Four opening portions 61 (see FIG. 6) and four attachment portions 62 (see FIG. 3) are formed in the container attachment portion 52. The front cover 9A is opened and closed when a toner container 51 attached to an attachment portion 62 is removed from the attachment portion 62. The front cover 9A is an example of a cover member of the present disclosure.

The four opening portions 61 are provided in correspondence with the four toner containers 51. The toner containers 51 are inserted into the corresponding opening portions 61. For example, the toner container 51A is inserted into an opening portion 61A shown in FIG. 6.

The four attachment portions 62 are provided in correspondence with the four opening portions 61. Each attachment portion 62 forms a storage space for storing a toner container 51, extending from the corresponding opening portion 61 toward the rear of the image forming apparatus 100. The toner containers 51 are attached to the attachment portions 62. For example, the toner container 51A is attached to an attachment portion 62A shown in FIG. 3.

The lock unit 53 is configured to regulate the removal of the toner containers 51 attached to the container attachment portion 52 from the container attachment portion 52. As shown in FIG. 2, the lock unit 53 is mounted to the front of the container attachment portion 52. The lock unit 53 includes four lock devices 63 configured to individually switch between placing and not placing restrictions on opening and closing of (between locking and not locking) the four opening portions 61.

The four lock devices 63 have the same configuration as each other. Specifically, as shown in FIG. 7, each lock device 63 includes a lock cover 71, a restriction member 72, a coil spring 73, a solenoid 74, and a link member 75. The restriction member 72, the coil spring 73, the solenoid 74, and the link member 75 in each lock device 63 are provided on an upper surface of the corresponding attachment portion 62. Each lock device 63 regulates the removal of a toner container 51 attached to the corresponding attachment portion 62 from the attachment portion 62. The lock device 63 is an example of a regulation portion of the present disclosure.

The lock cover 71 is provided at each opening portion 61 in such a way as to open and close the opening portion 61. The lock cover 71 is supported such that its lower end portion is pivotable around a rotary shaft that is elongated in the left-right direction D3. That is, the lock cover 71 is opened as its upper part pivots forward, in the same manner as the front cover 9A.

An engaged portion 71A that can be engaged with an engaging portion 72A of the restriction member 72, is provided at the upper part of the lock cover 71. As shown in FIG. 7, the engaged portion 71A has a hook shape that protrudes from the rear of the lock cover 71 and bends to the right.

The restriction member 72 includes the engaging portion 72A that is engaged with the engaged portion 71A of the lock cover 71. As shown in FIG. 7, the engaging portion 72A has a hook shape that protrudes forward and bends to the left. The restriction member 72 is pivotably provided on the upper surface of each attachment portion 62. Specifically, the restriction member 72 is pivotably supported by a rotary shaft 72B that is provided parallel to the up-down direction D1, on the upper surface of each attachment portion 62.

The restriction member 72 can be rotated between a lock position where opening of the lock cover 71 can be restricted and a releasing position where opening restriction (locking) of the lock cover 71 is released. Here, as shown in FIG. 7, the lock position is a position where the engaging portion 72A is engaged with the engaged portion 71A of the closed lock cover 71. In addition, the releasing position is more inside the lock cover 71 than the lock position, and is a position where the engagement between the engaging portion 72A and the engaged portion 71A of the lock cover 71 is released (see a lock device 63C in FIG. 7). In the lock device 63, opening of the lock cover 71 is restricted by the restriction member 72, and thereby attachment/detachment of a toner container 51 to/from the corresponding attachment portion 62 is regulated.

The coil spring 73 biases the restriction member 72 toward the lock position side. Specifically, as shown in FIG. 7, the coil spring 73 extends in the left-right direction D3 on the upper surface of each attachment portion 62. One end of the coil spring 73 in the longitudinal direction is fixed to the left side of the restriction member 72, and the other end is fixed to the upper surface of each attachment portion 62. The coil spring 73 is fixed to the restriction member 72 and the upper surface of each attachment portion 62 in a state of being stretched to be longer than its natural length. Therefore, the restriction member 72 is pulled to the left direction by the coil spring 73 and biased to the lock position side.

As shown in FIG. 7, the solenoid 74 is provided more inside the lock cover 71 than the restriction member 72. The solenoid 74 is driven in response to energization to cause the restriction member 72 to be moved to the releasing position. Specifically, the solenoid 74 has what is called a pull-type driven configuration, and has a plunger that is elongated along the front-rear direction D2. The plunger is connected to the restriction member 72 via the link member 75 that is elongated in the front-rear direction D2.

The solenoid 74 drives the plunger rearward in response to power supply from a power source (not shown) based on control commands of the first control portion 7. Thus, the restriction member 72 that is connected to the plunger via the link member 75 is moved from the lock position to the releasing position, and then locking of the lock cover 71 is released (see the lock device 63C in FIG. 7).

The drive portion 54 is provided in each attachment portion 62. The drive portion 54 generates a rotational driving force that is supplied to the conveyance member of a toner container 51 attached to an attachment portion 62 corresponding to the drive portion 54. For example, the drive portion 54 is a motor. The rotational driving force generated in the drive portion 54 is supplied to the conveyance member of the toner container 51 attached to the corresponding attachment portion 62 via a power transmission mechanism (not shown). Thus, the conveyance member is rotated so that the toner stored in the toner container 51 is conveyed to a toner outlet (not shown) provided inside the toner container 51. The toner outlet of the toner container 51 attached to the corresponding attachment portion 62 is connected to a toner supply path (not shown) leading to the opening portion 47 (see FIG. 4) of the development portion 23. The toner that is discharged from the toner outlet to the outside of the toner container 51 is supplied to the development portion 23 via the toner supply path and the opening portion 47.

The data acquisition portion 55 is provided in each attachment portion 62. The data acquisition portion 55 acquires the specific data from the IC tag of a toner container 51 attached to an attachment portion 62 corresponding to the data acquisition portion 55. For example, the data acquisition portion 55 receives the specific data from the IC tag by executing short-range wireless communication with the IC tag of the toner container 51 attached to the corresponding attachment portion 62.

The open/close sensor 56 detects whether the front cover 9A of the housing 9 is in an opened state or a closed state. For example, the open/close sensor 56 is a reflective optical sensor.

[Configuration of First Control Portion 7 and Second Control Portion 8]

Next, a configuration of the first control portion 7 and the second control portion 8 will be described with reference to FIG. 1.

As shown in FIG. 1, the second control portion 8 includes a detection portion 81.

The detection portion 81 detects abnormality regarding the image forming portion 3.

For example, the abnormality includes abnormalities of the drive portion 54 and the data acquisition portion 55. In addition, the abnormality includes abnormalities of the image forming units 11 to 14, the laser scanning unit 15, a motor that causes the intermediate transfer belt 16 to be rotated, and the fixing device 18. In addition, the abnormality includes shortage of the developer, shortage of the sheets, and paper jam.

The second control portion 8 notifies the first control portion 7 when the abnormality is detected by the detection portion 81.

As shown in FIG. 1, the first control portion 7 includes a restriction processing portion 91, a switching processing portion 92, a determination processing portion 93, and a release processing portion 94.

Specifically, a regulation releasing program for causing the CPU 7A of the first control portion 7 to execute an operation mode switching process (see a flowchart in FIG. 8) and a regulation releasing process (see a flowchart in FIG. 9), which will be described later, are prestored in the ROM 7B of the first control portion 7. The CPU 7A of the first control portion 7 functions as the above-described components by executing the regulation releasing program stored in the ROM 7B.

The regulation releasing program is recorded on a computer-readable recording medium such as CD, DVD, or flash memory, and may be read from the recording medium and stored in a storage device such as the storage portion 6.

The following describes an example case where, among the toner containers 51, the attachment portions 62, and the lock devices 63 corresponding to the image forming units 11 to 14, the toner container 51A (see FIG. 3), the attachment portion 62A (see FIG. 3), and the lock device 63A (see FIG. 2) corresponding to the image forming unit 11 are focused. The following description also applies to the toner containers 51, the attachment portions 62, and the lock devices 63 corresponding to the image forming units 12 to 14.

The restriction processing portion 91 restricts the operation of the image forming apparatus 100 when the abnormality is detected by the detection portion 81.

Specifically, when detection of the abnormality is notified from the second control portion 8, the restriction processing portion 91 stops a process under execution, and also prohibits a new process to be executed. A target to be restricted by the restriction processing portion 91 includes the process without using the image forming portion 3, for example, an image reading process using the image reading portion 2.

When the abnormality detected by the detection portion 81 is a predetermined first abnormality, the switching processing portion 92 switches an operation mode of the image forming apparatus 100 from a normal mode to a stop mode in which the second control portion 8 is stopped. The switching processing portion 92 is also configured to release the restriction on the operation of the image forming apparatus 100 imposed by the restriction processing portion 91.

For example, the first abnormality includes abnormalities of the drive portion 54, and the data acquisition portion 55. In addition, the first abnormality includes abnormalities of the image forming units 11 to 14, the laser scanning unit 15, a motor that causes the intermediate transfer belt 16 to be rotated, and the fixing device 18. The first abnormality does not include shortage of the developer, shortage of the sheets, and paper jam.

For example, when the abnormality detected by the detection portion 81 is the first abnormality, the switching processing portion 92 causes a switching screen used for performing a switching operation to switch the operation modes of the image forming apparatus 100, to be displayed on the operation/display portion 5. The switching processing portion 92 switches the operation mode of the image forming apparatus 100 from the normal mode to the stop mode in accordance with the switching operation performed on the switching screen, and releases the restriction on the operation of the image forming apparatus 100 imposed by the restriction processing portion 91. In the stop mode, the print function cannot be used. Also in the stop mode, the scan function can be used.

When the abnormality detected by the detection portion 81 is the first abnormality, the switching processing portion 92 may switch the operation mode of the image forming apparatus 100 from the normal mode to the stop mode without accepting the switching operation, and release the restriction on the operation of the image forming apparatus 100 imposed by the restriction processing portion 91.

Meanwhile, in the conventional image forming apparatus, when a predetermined specific operation, such as an operation to open the front cover 9A, is performed, it is determined whether or not a predetermined second abnormality in the above-described abnormality is continued based on a result of communication with the second control portion 8. When it is determined that the second abnormality is continued, regulation on a removal of the toner container 51A imposed by the lock device 63A is released. Thus, in the occurrence of the abnormality (the second abnormality) that requires the removal of the toner container 51A in order to investigate and eliminate a cause of the abnormality, it is possible to remove the toner container 51A. For example, the second abnormality includes abnormalities of the drive portion 54 and the data acquisition portion 55.

Here, in the conventional image forming apparatus, when the specific operation is performed, in a case where the operation mode of the image forming apparatus 100 is the stop mode, the regulation on the removal of the toner container 51A is not released even when the second abnormality is continued, because the second control portion 8 is stopped. Therefore, it takes time and effort for a user to switch the operation mode of the image forming apparatus 100 to remove the toner container 51A.

On the other hand, in the image forming apparatus 100 according to the embodiment of the present disclosure, it is possible to reduce the time and effort for the user to remove the toner container 51A during the stop of the second control portion 8, as described below.

When the specific operation is performed, in a case where the operation mode of the image forming apparatus 100 is not the stop mode, the determination processing portion 93 determines whether or not the second abnormality is continued, based on the result of communication with the second control portion 8. In addition, when the specific operation is performed, in a case where the operation mode of the image forming apparatus 100 is the stop mode, the determination processing portion 93 determines whether or not the second abnormality is continued, based on a record result of the abnormality detection.

For example, when the abnormality detection is notified from the second control portion 8, the first control portion 7 records the abnormality detection. For example, the first control portion 7 stores a piece of abnormality detection information regarding an abnormality detected by the detection portion 81, in a predetermined specific storage area of the storage portion 6.

In addition, when the specific operation is performed, in a case where the operation mode of the image forming apparatus 100 is the stop mode, the determination processing portion 93 determines whether or not the second abnormality is continued, based on the information stored in the specific storage area of the storage portion 6.

For example, the determination processing portion 93 detects whether the operation to open the front cover 9A (the specific operation) has been performed, by using the open/close sensor 56. It is noted that the specific operation may be a predetermined operation performed on the operation/display portion 5.

The second abnormality is not limited to abnormalities of the drive portion 54 and the data acquisition portion 55. The second abnormality may be any abnormality that requires the removal of the toner container 51A to investigate and eliminate the cause of the abnormality.

In addition, when the specific operation is performed, the determination processing portion 93 may determine whether or not the second abnormality is continued, based on the record result of the abnormality detection, regardless of the operation mode of the image forming apparatus 100.

When the determination processing portion 93 determines that the second abnormality is continued, the release processing portion 94 releases the regulation on the removal of the toner container 51A imposed by the lock device 63A.

Specifically, the release processing portion 94 releases regulation on the removal of the toner container 51A imposed by the lock device 63A, by driving the solenoid 74 of the lock device 63A so that the restriction member 72 of the lock device 63A is moved from the lock position to the releasing position.

[Operation Mode Switching Process]

Figure 8:
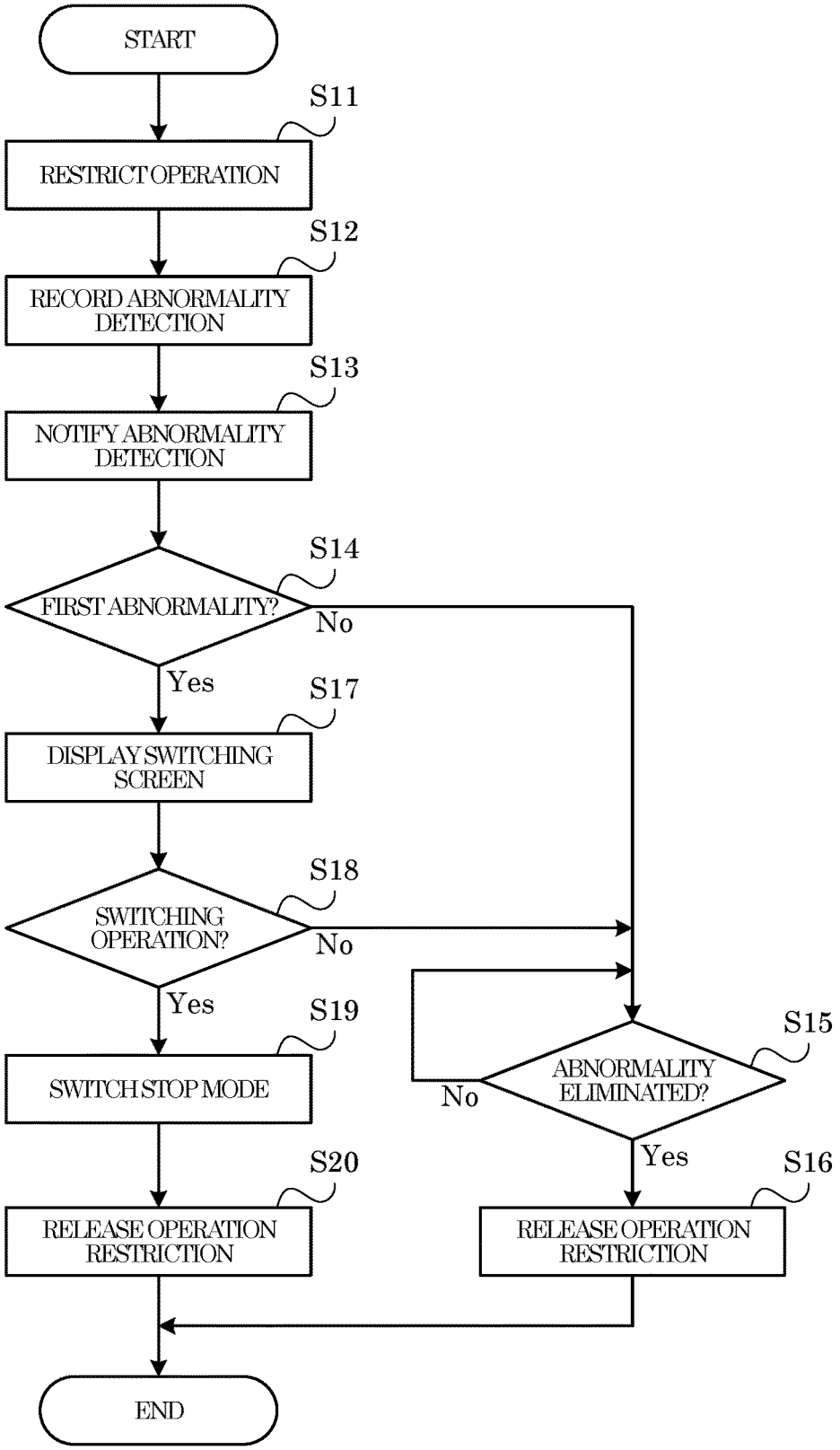
FIG. 8 is a flowchart showing one example of an operation mode switching process that is executed in the image forming apparatus according to the embodiment of the present disclosure.

The following describes an example of the procedure of an operation mode switching process executed by the first control portion 7 in the image forming apparatus 100, as well as a part of a regulation releasing method of the present disclosure, with reference to FIG. 8. Here, steps S11, S12 . . . represent the reference number of process procedures (steps) executed by the first control portion 7. The operation mode switching process is executed when the abnormality detection is notified from the second control portion 8.

<Step S11>

In step S11, the first control portion 7 restricts the operation of the image forming apparatus 100. Here, the process of step S11 is an example of a restriction step of the present disclosure, and is executed by the restriction processing portion 91 of the first control portion 7.

Specifically, the first control portion 7 causes a process under execution to be stopped, and prohibits execution of a new process.

<Step S12>

In step S12, the first control portion 7 records the abnormality detection notified from the second control portion 8.

For example, the first control portion 7 stores the piece of the abnormality detection information regarding the abnormality detected by the detection portion 81, in the specific storage area of the storage portion 6.

<Step S13>

In step S13, the first control portion 7 notifies the abnormality detection notified from the second control portion 8.

For example, the first control portion 7 displays, on the operation/display portion 5, a notification screen including the abnormality detection and information such as an error code indicating the type of the detected abnormality.

<Step S14>

In step S14, the first control portion 7 determines whether or not the abnormality notified from the second control portion 8 is the first abnormality.

Here, upon determining that the abnormality notified from the second control portion 8 is the first abnormality (Yes in step S14), the first control portion 7 shifts the process to step S17. In addition, upon determining that the abnormality notified from the second control portion 8 is not the first abnormality (No in step S14), the first control portion 7 shifts the process to step S15.

<Step S15>

In step S15, the first control portion 7 determines whether or not the abnormality notified from the second control portion 8 is eliminated.

For example, the first control portion 7 causes the second control portion 8 to confirm that the abnormality is eliminated, in accordance with a predetermined user operation performed on the operation/display portion 5. The first control portion 7 determines that the abnormality is eliminated, upon receipt of notification from the second control portion 8 confirming that the abnormality is eliminated.

Here, upon determining that the abnormality notified from the second control portion 8 is eliminated (Yes in step S15), the first control portion 7 shifts the process to step S16. In addition, upon determining that the abnormality notified from the second control portion 8 is not eliminated (No in step S15), the first control portion 7 waits for elimination of the abnormality notified from the second control portion 8, in step S15.

<Step S16>

In step S16, the first control portion 7 releases restriction on the operation of the image forming apparatus 100 imposed by step S11.

<Step S17>

In step S17, the first control portion 7 displays the switching screen on the operation/display portion 5.

<Step S18>

In step S18, the first control portion 7 determines whether or not the switching operation has been performed on the switching screen displayed in step S17.

Here, upon determining that the switching operation has been performed (Yes in step S18), the first control portion 7 shifts the process to step S19. In addition, when the switching screen is terminated without performance of the switching operation (No in step S18), the control portion 7 shifts the process to step S15.

<Step S19>

In step S19, the first control portion 7 switches the operation mode of the image forming apparatus 100 from the normal mode to the stop mode.

<Step S20>

In step S20, the first control portion 7 releases restriction on the operation of the image forming apparatus 100 imposed by step S11. Here, the processes of step S19 and step S20 are an example of a switching step of the present disclosure, and are executed by the switching processing portion 92 of the first control portion 7.

[Regulation Releasing Process]

Figure 9:
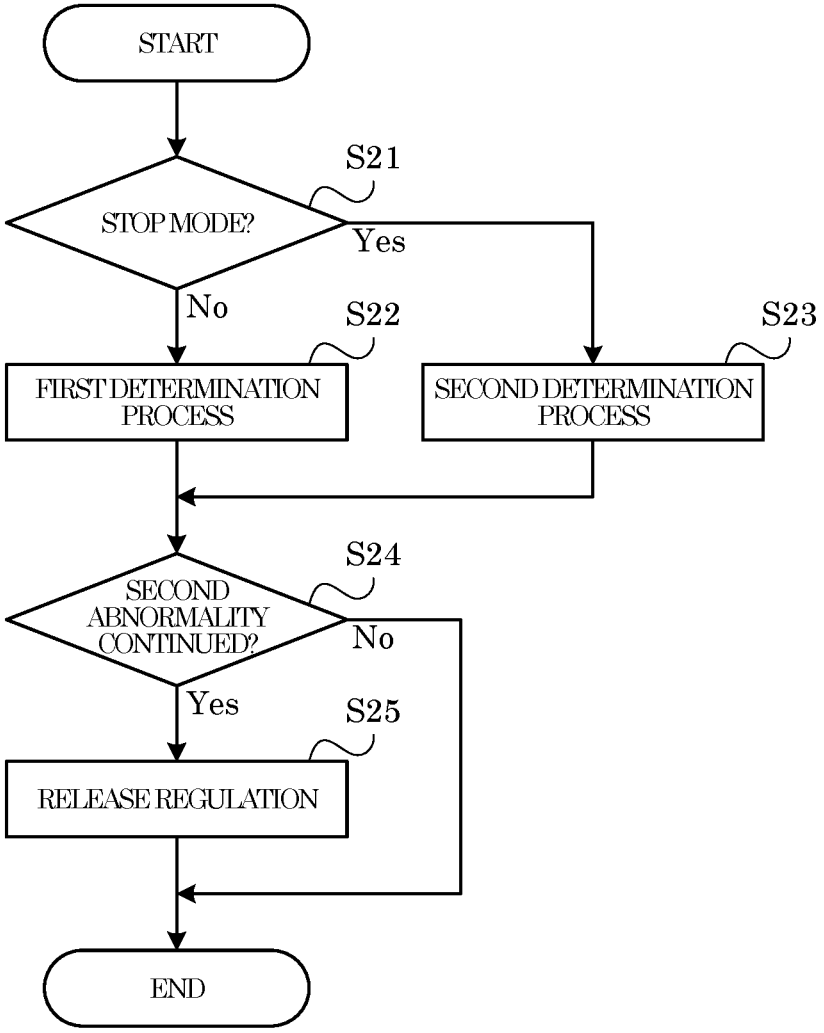
FIG. 9 is a flowchart showing one example of a regulation releasing process that is executed in the image forming apparatus according to the embodiment of the present disclosure.

Next, the following describes an example of the procedure of the regulation releasing process executed by the first control portion 7 in the image forming apparatus 100, as well as the remaining part of the regulation releasing method of the present disclosure, with reference to FIG. 9. The regulation releasing process is executed when the specific operation is performed.

<Step S21>

In step S21, the first control portion 7 determines whether or not the operation mode of the image forming apparatus 100 is the stop mode.

Here, upon determining that the operation mode of the image forming apparatus 100 is the stop mode (Yes in step S21), the first control portion 7 shifts the process to step S23. In addition, upon determining that the operation mode of the image forming apparatus 100 is not the stop mode (No in step S21), the first control portion 7 shifts the process to step S22.

<Step S22>

In step S22, the first control portion 7 executes a first determination process to determine whether or not the second abnormality is continued, based on the result of communication with the second control portion 8.

<Step S23>

In step S23, the first control portion 7 executes a second determination process to determine whether or not the second abnormality is continued, based on the record result of the abnormality detection. Here, the processes of step S21 and step S22, or the processes of step S21 and step S23 are an example of a determination step of the present disclosure, and are executed by the determination processing portion 93 of the first control portion 7.

For example, the first control portion 7 determines whether or not the second abnormality is continued, based on the information stored in the specific storage area of the storage portion 6.

<Step S24>

In step S24, the first control portion 7 causes the process to be branched in accordance with a process result of the first determination process or the second determination process. Specifically, upon determining that the second abnormality is continued (Yes in step S24), the first control portion 7 shifts the process to step S25. In addition, upon determining that the second abnormality is not continued (No in step S24), the first control portion 7 terminates the regulation releasing process.

<Step S25>

In step S25, the first control portion 7 releases the regulation on the removal of the toner container 51A imposed by the lock device 63A. Here, the process of step S25 is an example of a releasing step of the present disclosure, and is executed by the release processing portion 94 of the first control portion 7.

Specifically, the first control portion 7 drives the solenoid 74 of the lock device 63A to move the restriction member 72 of the lock device 63A from the lock position to the releasing position, thereby releasing regulation on the removal of the toner container 51A imposed by the lock device 63A.

As described above, in the image forming apparatus 100, when the specific operation is performed, in a case where the operation mode of the image forming apparatus 100 is the stop mode, it is determined whether or not the second abnormality is continued, based on the record result of the abnormality detection. Thus, as compared with a configuration in which it is determined whether or not the second abnormality is continued based on the result of communication with the second control portion 8, regardless of the operation mode of the image forming apparatus 100, it is possible to save time and effort of switching the operation mode of the image forming apparatus 100 from the stop mode to the normal mode in order to determine whether or not the second abnormality is continued. Therefore, it is possible to reduce time and effort for the user to remove the toner container 51A during the stop of the second control portion 8.

The present disclosure may be applied to an image forming apparatus that forms an image by other image forming methods such as an inkjet method.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus including a printer that forms an image by using developer, the image forming apparatus comprising:

a housing to which a developer storing portion storing the developer is attached;

a lock device that regulates a removal of the developer storing portion attached to the housing from the housing;

a control circuit that detects an abnormality regarding the printer, and controls the printer; and a processor provided independent of the control circuit, wherein upon detecting the abnormality, the control circuit notifies the processor that the abnormality was detected, upon being notified from the control circuit that the abnormality was detected, the processor records an abnormality detection, and the processor functions as:

a restriction processing portion that restricts an operation of the image forming apparatus including execution of a process in which the printer is not used, when the abnormality is detected by the control circuit;

a switching processing portion configured to, in a case where the abnormality detected by the control circuit is a predetermined first abnormality, switch an operation mode of the image forming apparatus from a normal mode to a stop mode in which the control circuit is stopped, and release restriction on the operation of the image forming apparatus imposed by the restriction processing portion;

a determination processing portion that determines, when a predetermined specific operation is performed in a case where the operation mode is the stop mode, whether or not the predetermined first abnormality that was detected when the operation mode was switched to the stop mode is a predetermined second abnormality, based on a record result of detection of the abnormality; and a release processing portion that releases regulation on the removal of the developer storing portion imposed by the lock device when the determination processing portion determines that the predetermined first abnormality that was detected when the operation mode was switched to the stop mode is the predetermined second abnormality.

2. The image forming apparatus according to claim 1, further comprising:

a cover that is opened or closed when the developer storing portion attached to the housing is removed from the housing, wherein the specific operation includes an operation to open the cover.

3. The image forming apparatus according to claim 1, further comprising:

a scanner that reads an image of a document sheet.

4. A regulation releasing method executed in an image forming apparatus including a printer that forms an image by using developer, a housing to which a developer storing portion storing the developer is attached, a lock device that regulates a removal of the developer storing portion attached to the housing from the housing, a control circuit that detects an abnormality regarding the printer and controls the printer and a processor provided independent of the control circuit, wherein upon detecting the abnormality, the control circuit notifies the processor that the abnormality was detected, upon being notified from the control circuit that the abnormality was detected, the processor records an abnormality detection, and the processor executes:

a restriction step of restricting an operation of the image forming apparatus including execution of a process in which the printer is not used, when the abnormality is detected by the control circuit;

a switching step of, in a case where the abnormality detected by the control circuit is a predetermined first abnormality, switching an operation mode of the image forming apparatus from a normal mode to a stop mode in which the control circuit is stopped, and releasing restriction on the operation of the image forming apparatus imposed by the restriction step;

a determination step of, when a predetermined specific operation is performed in a case where the operation mode is the stop mode, determining whether or not the predetermined first abnormality that was detected when the operation mode was switched to the stop mode is a predetermined second abnormality, based on a record result of abnormality detection; and a releasing step of, when the determination step determines that the predetermined first abnormality that was detected when the operation mode was switched to the stop mode is the predetermined second abnormality, releasing regulation on the removal of the developer storing portion imposed by the lock device.

* * * * *